United States Patent [19]

Unger et al.

[11] Patent Number: 4,507,198

[45] Date of Patent: Mar. 26, 1985

[54] FLOTATION COLLECTORS AND METHODS

[75] Inventors: Kim N. Unger; Rory L. Tibbals; Dennis V. Smeltzer, all of Tucson, Ariz.

[73] Assignee: Thiotech, Inc., Tucson, Ariz.

[21] Appl. No.: 451,011

[22] Filed: Dec. 20, 1982

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,208,171 | 12/1916 | Lavers et al. | 209/167 |
| 2,000,350 | 5/1935 | Patek | 209/166 |
| 2,838,369 | 6/1958 | Gaudin et al. | 209/166 |
| 4,040,950 | 8/1977 | Zipperian et al. | 209/166 |
| 4,104,157 | 8/1978 | Fountain et al. | 209/166 |
| 4,316,797 | 2/1982 | Parlman | 209/166 |
| 4,341,626 | 7/1982 | Dauplaise | 209/167 |
| 4,387,034 | 6/1983 | Unger et al. | 209/166 |
| 4,388,181 | 6/1983 | Rainis et al. | 209/166 |

FOREIGN PATENT DOCUMENTS

| | | | |
|---|---|---|---|
| 103509 | 3/1938 | Australia | 209/166 |
| 446418 | 4/1936 | United Kingdom | 209/166 |
| 527206 | 7/1977 | U.S.S.R. | 209/166 |
| 697195 | 11/1979 | U.S.S.R. | 209/166 |

*Primary Examiner*—Bernard Nozick

*Attorney, Agent, or Firm*—Weiss & Holloway

[57] ABSTRACT

A collector for use in concentrating metal values in ores by flotation, said collector comprising a mixture of (A) an O-alkyl N-alkylthionocarbamate wherein each alkyl radicals has from 1 to 6 carbon atoms and (B) at least 30 percent by weight of (A) of a normally liquid tall oil fatty acid fraction.

4 Claims, No Drawings

FLOTATION COLLECTORS AND METHODS

BACKGROUND OF THE INVENTION

1. Field of the Invention

This invention relates generally to ore dressing and to concentration of metal values in ores by flotation. More particularly the invention provides new and valuable methods of recovering metal values from ores, whereby froth flotation of a slurry of the ore is conducted in the presence of a collector comprising an organic thionocarbamate in admixture with an inert, organic liquid as extender therefor.

2. Description of the Prior Art

The flotation method of concentrating metal values in ores is based on the fact that when air bubbles are introduced into a ground ore pulp, particles of some minerals will become attached to the bubbles, whereas other minerals will not become so attached and remain in the pulp. Certain chemicals facilitate flotation by conferring adherency and/or water repellency to surfaces of minerals to be floated, and such chemicals have been generally called "promoters" or "collectors". Herein, they will be referred to as collectors. It is customary in the art to employ other reagents in flotation; for example, there may also be used materials which serve as frothers, activators, depressants, or modifying agents. The presence or absence of such reagents and their nature will vary with ores and reaction conditions, and selection of such other additives for serving differing functions can be readily arrived at by routine experimentation.

In the prior art, numerous materials have been reported to serve as collectors; for example, the xanthates, the thiocarbanilides and the thionocarbamates. Industrially, collectors for use in flotation are of great importance because even a very small improvement in the efficacy of the collector can have immense commercial effect. With the growing current practice of tailings retreatment, the cost efficiency of the collector becomes increasingly significant. Unfortunately, the more valuable collectors, for example, the organic thionocarbamates are expensive materials. Heretofore, research which has been directed at providing inexpensive, readily available materials having collector efficacy has not been very successful.

SUMMARY OF THE INVENTION

Accordingly, an object of the invention is the provision of a flotation method which provides for efficient recovery of metal values at nominal cost.

Another object of the invention is to provide an efficient collector and also a way to reduce the cost of the prior expensive collectors without a substantial lowering of their collector efficiency.

A paramount objective is the provision of a flotation method which will be useful with a great variety of sulfidic and non-sulfidic ores, including those of the precious metals.

Still another object is the provision of a method which will be effective even under conditions where slime interference may present a problem.

A most important object is the provision of an efficient collector for recovering metal values from sulfide ores, and especially from copper sulfides and molybdenum sulfides.

These and other objects hereinafter disclosed are met by the invention wherein there is provided a collector comprising a mixture of (A) a thionocarbamate of the formula

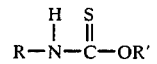

wherein each of R and R′ is an alkyl radical of from 1 to 6 carbon atoms and (B) a normally liquid, organic material selected from the class consisting of hydrocarbon alcohols, hydrocarbon aldehydes, hydrocarbon ketones and hydrocarbon carboxylic acids and mixtures of the same, said mixture consisting of at least 10 percent by weight of (A).

It has been discovered that, surprisingly, the presence of the normally liquid organic material which possesses little, if any, collector efficacy in itself, serves as an extender of the collector efficacy of the thionocarbamates. For example, ten parts by weight of a collector consisting of 2 parts by weight of thionocarbamate and 8 parts by weight of (B) can have the collector efficacy of 10 parts by weight of the thionocarbamate, even though in itself (B) has little, if any, such efficacy. Liquid (B) thus extends collector efficacy in a synergistic manner; hereinafter, it will be referred to as an extender.

Thionocarbamates of the above formula and which are included in this invention are, for example, those in which each of R and R′ is methyl, ethyl, propyl, n-butyl, tert-butyl, isoamyl, or IV-hexyl. For example:

O-isopropyl N-ethylthionocarbamate
O-isobutyl N-methylthionocarbamate
O-methyl N-isobutylthionocarbamate
O-hexyl N-ethylthionocarbamate
O-ethyl N-methylthionocarbamate
O-isopropyl N-isopropylthionocarbamate
O-butyl N-hexylthionocarbamate.

Any number of different thionocarmamates may be present in the collector. Synergism may be demonstrated not only by the presence of a mixture of thionocarbamates as well as by the presence of the organic liquid extender.

The normally liquid, organic material may be a hydrocarbon alcohol or aldehyde or ketone; and it may be aliphatic, cycloaliphatic, aromatic, aralkyl or alkaryl, saturated or unsaturated. Because the purpose of the invention is to provide collector efficacy at the lowest cost, it is advantageous to use materials which may be crude mixtures of by-products in the chemical industry. Mixtures of fatty acids such as the tar oil fatty acids, oxidation products obtained by the oxo reaction from unsaturated hydrocarbons, e.g., the butylaldehydes obtained from propylene or the octanols obtained from heptenes are examples of extenders which have been found to be useful with thionocarbamates as collectors in concentrating metal values of ores by flotation. Although crude ogygenated oil fractions may be generally looked to for providing an inexpensive tool in a highly competitive industry, modern manufacturing methods often provide substantially uniform fractions or isolated liquid compounds which are eminently suited to the present operation. For example, there may be employed with the O-alkyl N-ethylthionocarbamate compounds like benzaldehyde, or pentanol or ethyl methyl ketone. Although the extender effect of the normally liquid, organic material can only be speculated upon, it is believed that the collector property of the thionocarbamate is caused to be shared by the otherwise substantially inactive liquid.

Although the present invention is very valuable for the concentration of copper, the mixtures of thionocarbamates and normally liquid organic materials servce as excellent collectors in flotation processes, generally, including concentration of metals such as silver, gold, and zinc from ores in which such metals may be present at only very low levels. The mixtures of thionocarbamate and extender are effective over a wide pH range, and can provide improved selectivity at substantial time savings in alkaline flotation circuits.

The invention is further illustrated by, but not limited to, the following examples:

EXAMPLE 1

This example describes testing of the following materials for collector efficacy in copper flotation:

I. O-isopropyl N-ethylthionocarbamate

II. A tall oil fatty acid fraction is commercially available as XTOL LIGHT from Tall Oil and Specialty Chemicals, Resin Division, P.O. Box 105042, Altanta, Ga. 30348. It is reported to have a 150 minimum acid number, a 71% by weight content of fatty acids, a 4% by weight content of rosin acids, a 25% by weight content of unsaponifiables, a color of 10 ¾ 12 on the the Gardner scale., and a titre of 37° C.

III. A 1:3 by weight mixture of I and II.

Copper ore (Cyprus Bagdad) was crushed to 10 mesh and 700 g of the crushed ore was ground in the laboratory ball mill together with 500 ml of water, 20 g of lime and 2 mg of one of the collectors I–III, corresponding to about 0.007 lb of collector per ton of ore. The resulting slurry, together with 20 g of a frothing agent (a 1:1 by weight mixture of norpine and methylisobutylcarbinol) was then agitated with air in a laboratory flotation machine during a flotation time of 4 minutes. The concentrates thus obtained were assayed for copper and the percent recovery of copper in the concentrates was determined. The following results were obtained:

| Collector | Cu Assay of Concentrate | Weight % of Cu recovered in Concentrate |
|---|---|---|
| I | 12.235 | 92.75 |
| II | 9.931 | 75.87 |
| III | 11.045 | 92.81 |

The procedure of Example 1 was repeated, except that greater quantities of collector were employed; and, in addition to collectors I–III, there was also employed collector IV, a 1:1 by weight mixture of collectors I and II. The following results were obtained:

| Collector | Weight of Collector, mg. | Assay of Concentrate, Cu | Weight % of Cu recovered Concentrate |
|---|---|---|---|
| I | 10 | 8.762 | 93.29 |
| I | 20 | 10.119 | 93.54 |
| II | 10 | 10.79 | 87.19 |
| II | 20 | 10.705 | 87.63 |
| III | 10 | 10.547 | 93.57 |
| III | 20 | 10.230 | 93.48 |
| IV | 10 | 10.724 | 92.92 |
| IV | 20 | 10.236 | 93.49 |

The above data shows that a mixture of O-isopropyl N-ethylthionocarbamate and the tall oil fatty acid fraction which may contain a preponderance of said tall oil material demonstrates substantially the collector efficiency of the said carbamate, alone. However, in the absence of the carbamate, the collector efficiency of the tall oil material is significantly decreased.

EXAMPLE 3

Employing the procedure and materials described in tall oil fatty acid, Examples 1 and 2, assay of the concentrate for molybdenum gave the following results:

| Collector | Collector, mg. | Assay of concentrate for Mo | Mo Recovery in Concentrate wt. |
|---|---|---|---|
| I | 2 | 0.2579 | 85.85 |
| I | 10 | 0.168 | 91.89 |
| I | 20 | 0.1984 | 85.48 |
| III | 2 | 0.2165 | 83.69 |
| III | 10 | 0.2326 | 83.03 |
| III | 20 | 0.2067 | 82.57 |
| IV | 2 | 0.2282 | 88.09 |
| IV | 10 | 0.2148 | 82.41 |
| IV | 20 | 0.2165 | 88.87 |

The above data shows that replacement of the thionocarbamate with large proportions of the tall oil fatty acid fraction has substantially no effect on the grade and percent recovery of molybdenum.

EXAMPLE 4

Cuajone copper ore was used in this example, together with the commercially available Cuajone frother, which frother is reputed to consist of about 40% by weight of triethoxybutane and 60% by weight of American Cyanamid Corporation's "Aerofroth 73", a No. 2 fuel oil.

A mixture consisting of 700 g of the crushed ore (10 mesh), 500 ml of water, 1.5 g of lime, 35 mg of said Cuajone frother, and 2 mg of one of the collector's shown below was ground in the laboratory ball mill.

I. O-isopropyl N-ethylthionocarbamate

II. The tall oil fatty acid fraction described in Example 1,

III. A 1:3 by weight mixture of I and II

IV. A 1:1 weight mixture of I and II.

The resulting slurry was transferred to a laboratory flotation machine and agitated with air during a flotation time of 4 minutes. The following results were obtained:

| Collector | Assay of Cu in concentrate | Weight % recovered Cu in concentrate |
|---|---|---|
| I | 16.69 | 88.86 |
| II | 14.911 | 77.03 |
| III | 18.896 | 86.02 |
| IV | 17.402 | 87.77 |

It will be noted that in all four instances, the frother was present in ball milling, but that in absence of the carbamate the amount of recovered copper was significantly lower than with either the carbamate, alone, or with the mixture of the latter with the tall oil fraction. What is required appears to be not frother, but the thiocarbamate, alone, or in admixture with the tall oil fraction.

EXAMPLE 5

The effect of various oxygen-containing organic liquids on the recovery efficacy of the present thionocarbamates was studied in the flotation of a porphyry ore produced at Morenci, Ariz. The following results were obtained by using 15 mg of O-isopropyl N-ethylthionocarbamate as collector and by using as collectors in the same procedure mixtures in which at least half of the said thionocarbamate had been replaced with the extenders shown below:

| Extender | Weight % of recovered Cu in the concentrate |
|---|---|
| None (only thionocarbamate) | 84.72 |
| Hexanol | 82.08 |
| Pentanol | 84 |
| Benzaldehyde | 82.54 |
| Cyclohexanone | 80 |
| 2-Methylpentanol | 83.47 |

Consistently poor results were obtained in the absence of the thionocarbamate. That substantially the same efficacy is shown by the extended thionocarbamate as by the thionocarbamate, alone, represents an important economic advantage in commercial operation.

Mixtures of the present O-alkyl N-alkylthionocarbamates with inert, organic liquids as extenders therefor are generally useful in ore dressing, but they are particularly valuable for working with sulfides in that they demonstrate high selectivity against pyrite and pyrrhotite. They possess exceptional utility in the flotation of sulfide copper and copper activated zinc sulfide from alkaline pulps. In many cases where slime or talc interference is a problem, the herein described extended thionocarbamates will produce higher concentrate grades and recoveries. In the flotation of precious metals such as gold and silver, the presently provided mixtures have been found to possess significant affinity.

The herein described flotation procedures are given by way of illustration only, since an ore dressing flotation technique may be used as long as the presently provided extended thionocarbamates are employed as collectors.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A collector for use in concentrating metal values in ores by flotation, said collector comprising a mixture of (A) an O-alkyl N-alkylthionocarbamate wherein each alkyl radical has from 1 to 6 carbon atoms and (B) at least 30 percent by weight of (A) of a normally liquid tall oil fatty acid fraction.

2. The collector defined in claim 1, further limited in that said thionocarbamate is O-isopropyl N-ethylthionocarbamate.

3. The collector defined in claim 1, further limited in that said thionocarbamate is O-isobutyl N-methylthionocarbamate.

4. A method for concentrating metal values in ores wherein there is employed the collector defined in claim 1.

* * * * *